US009907442B2

(12) United States Patent
Cvjetkovic

(10) Patent No.: US 9,907,442 B2
(45) Date of Patent: Mar. 6, 2018

(54) PAPER TOWELING OR TISSUE DISPENSING APPARATUS INCLUDING ROLL OVERSPIN CONTROL

(71) Applicant: DISPENSING DYNAMICS INTERNATIONAL, City of Industry, CA (US)

(72) Inventor: Niko Anthony Cvjetkovic, Los Alamitos, CA (US)

(73) Assignee: Dispensing Dynamics International, LLC, City of Industry, CA (US)

( * ) Notice: Subject to any disclaimer, the term of this patent is extended or adjusted under 35 U.S.C. 154(b) by 261 days.

(21) Appl. No.: 14/629,599

(22) Filed: Feb. 24, 2015

(65) Prior Publication Data

US 2016/0242603 A1 Aug. 25, 2016

(51) Int. Cl.
*A47K 10/38* (2006.01)

(52) U.S. Cl.
CPC ..... *A47K 10/38* (2013.01); *A47K 2010/3863* (2013.01)

(58) Field of Classification Search
CPC ..... A47K 10/38; A47L 2010/3863
USPC ..... 242/596.7
See application file for complete search history.

(56) References Cited

U.S. PATENT DOCUMENTS 1,651,867 A * 12/1927 Boynton ..... A47K 10/22 242/596.3
1,802,251 A * 4/1931 Haister ..... B65H 16/06 242/596.1
1,913,363 A * 6/1933 Allen ..... A47K 10/22 242/596.4
2,164,817 A 7/1939 Harvey
2,370,821 A 3/1945 Stott
2,410,328 A * 10/1946 Agamaite, Jr. ..... A47K 10/22 242/422.4
2,514,778 A * 7/1950 Margo ..... A47K 10/40 211/85.12
2,896,871 A * 7/1959 Woodruff ..... A47K 10/22 242/560.3
4,234,136 A * 11/1980 Wenzel ..... B65H 16/06 242/598.1
4,610,407 A 9/1986 Stubbmann
4,858,840 A * 8/1989 Kidman ..... A47K 10/38 242/596.3
5,048,386 A 9/1991 DeLuca et al.
5,215,274 A 6/1993 Lin
5,249,755 A * 10/1993 Jespersen ..... A47K 10/38 242/422.4
5,782,428 A * 7/1998 Chabot ..... A47K 10/38 242/596.3
6,189,828 B1 * 2/2001 Reilly ..... A47K 10/40 242/596.4
6,286,781 B1 * 9/2001 Lai ..... A47K 10/40 242/596.4

(Continued)

FOREIGN PATENT DOCUMENTS

CA 2256105 6/2000
JP 4478997 11/2001

*Primary Examiner* — Michael E Gallion
(74) *Attorney, Agent, or Firm* — Thomas R. Lampe

(57) ABSTRACT

Dispenser apparatus for holding a roll of paper toweling or tissue sheet material and dispensing the sheet material, the apparatus including structure exerting drag forces on the roll to reduce overspin when pulling forces on the sheet material causing dispensing have been terminated.

12 Claims, 7 Drawing Sheets

(56) References Cited

U.S. PATENT DOCUMENTS

| | | | | |
|---|---|---|---|---|
| 6,415,948 | B1 | 7/2002 | Granger | |
| 6,666,364 | B2 * | 12/2003 | Phelps | A47K 10/40 225/106 |
| 7,513,453 | B2 * | 4/2009 | Cattacin | A47K 10/38 242/596.7 |
| 2004/0104300 | A1 * | 6/2004 | Friesen | A47K 10/3809 242/596.7 |
| 2006/0236832 | A1 * | 10/2006 | Cvjetkovic | A47K 10/38 83/337 |
| 2006/0266873 | A1 * | 11/2006 | Friesen | A47K 10/40 242/596.7 |
| 2013/0320128 | A1 * | 12/2013 | Cittadino | A47K 10/38 242/422.5 |
| 2014/0339281 | A1 * | 11/2014 | Flocchini | A47K 10/3836 225/106 |
| 2015/0150422 | A1 * | 6/2015 | Ochoa, Sr. | A47K 10/16 242/596.7 |
| 2016/0242603 | A1 * | 8/2016 | Cvjetkovic | A47K 10/38 |

* cited by examiner

PAPER TOWELING OR TISSUE DISPENSING APPARATUS INCLUDING ROLL OVERSPIN CONTROL

TECHNICAL FIELD

This invention relates to dispenser apparatus for holding a roll of paper toweling or tissue sheet material and for dispensing the sheet material during rotation of the roll.

BACKGROUND OF THE INVENTION

Overspin of a roll paper product such as paper toweling pulled during dispensing can create slack in the dispensed toweling remaining in a dispenser after the desired length has been dispensed. The slack segment can interfere with subsequent proper operation of some dispensers.

Dispenser arrangements are known which address the problem of overspin and slack creation. Such known devices are characterized by their relative complexity and high expense. The following patent documents are believed to be representative of the current state of the prior art in this field: U.S. Pat. No. 2,164,817, issued Jul. 4, 1939, U.S. Pat. No. 4,610,407, issued Sep. 9, 1986, U.S. Pat. No. 2,370,821, issued Mar. 6, 1945, U.S. Pat. No. 5,048,386, issued Sep. 17, 1991, U.S. Pat. No. 5,215,274, issued Jun. 1, 1993, U.S. Pat. No. 6,415,948, issued Jul. 9, 2002, Japanese Patent No. JP4478997, issued Jun. 9, 2010 and Canadian Patent Appln. No. 2,256,105, dated Dec. 15, 1998.

DISCLOSURE OF INVENTION

The present invention relates to dispenser apparatus for holding a roll of paper toweling or tissue sheet material having centrally disposed first and second roll support openings at opposite ends thereof and for dispensing the sheet material during rotation of the roll.

The dispenser apparatus includes a first roll support positioned in the first roll support opening, the first roll support operable to support the roll and allow rotation of the roll relative thereto to unwind the sheet material when a pulling force is applied to the sheet material.

The first roll support is configured to exert frictional drag forces on the roll to reduce overspin of the roll when the pulling force is terminated.

Other features, advantages and objects of the present invention will become apparent with reference to the following description and accompanying drawings.

MODES FOR CARRYING OUT THE INVENTION

Figure 1:
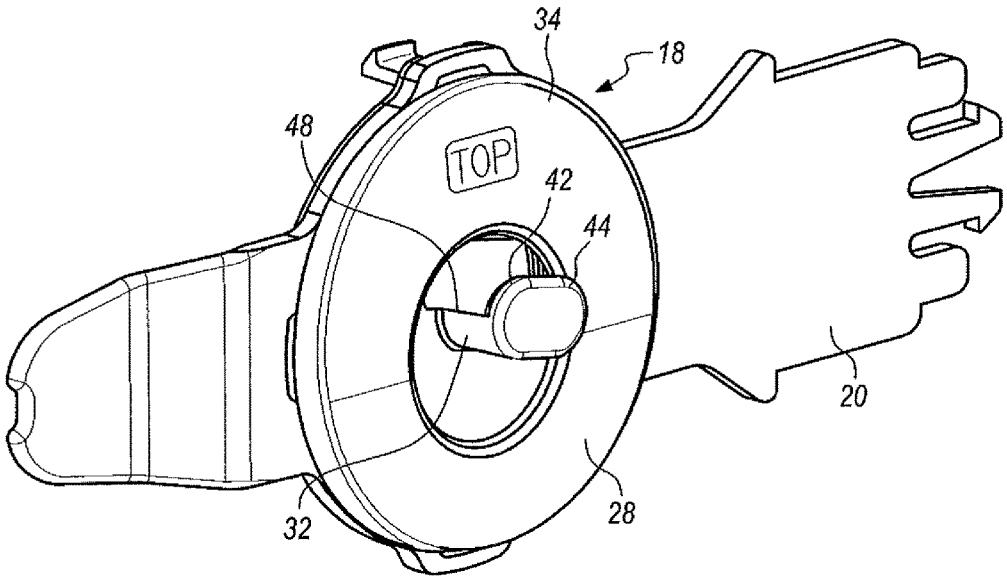
FIG. 1 is a perspective view of a first embodiment of the invention attached to a dispenser apparatus roll support arm.

Referring now to FIGS. 1-3, 5 and 6 of the drawings, dispenser apparatus constructed in accordance with the teachings of the present invention is illustrated. The dispenser apparatus is for holding a roll 12 of paper toweling or tissue sheet material having roll support openings 14, 16 at opposed ends thereof.

The dispenser apparatus is for dispensing the sheet material during rotation of the roll caused by a pulling force applied to the sheet material. The approach for applying pulling force to the sheet material for accomplishing dispensing may be use of any known prior art mechanical mechanisms or simply applying such forces manually to the toweling or tissue directly.

The dispenser apparatus incorporates a roll support 18 positioned in the roll support opening 14 and operable to support the roll and allow rotation of the roll relative thereto to unwind the sheet material when a pulling force is applied to the sheet material. The roll support 18 is configured to exert frictional drag forces on the roll 12 to reduce overspin of the roll when the pulling force is terminated.

Roll support 18 is configured to hold the weight of the roll off center. In this first embodiment of the invention, the roll support 18 is connected to and projects inwardly from a roll support arm 20 which may be of any suitable type commonly used in toweling and tissue roll dispensers.

A second roll support arm 24 is positioned at the other end of the roll and utilized to support the roll. Roll support arm 24 rotatably accommodates a plug 26 which is inserted into roll support opening 16. This latter arrangement is commonly employed to support a roll end and is merely exemplary since any suitable known arrangement for supporting the end of the roll at roll support opening 16 and allowing rotation of the roll may be employed.

Roll support 18 functions as an overspin control or reducer. This is accomplished by holding the weight of the roll off center. Roll support 18 includes a hub projection 28 and a hub projection support, the latter in this embodiment comprising a portion 30 of roll support arm 20, the hub projection being pivotal mounted relative to the hub projection support.

The hub projection includes a male portion 32 and a hub projection base 34 from which the male portion extends.

Figure 3:
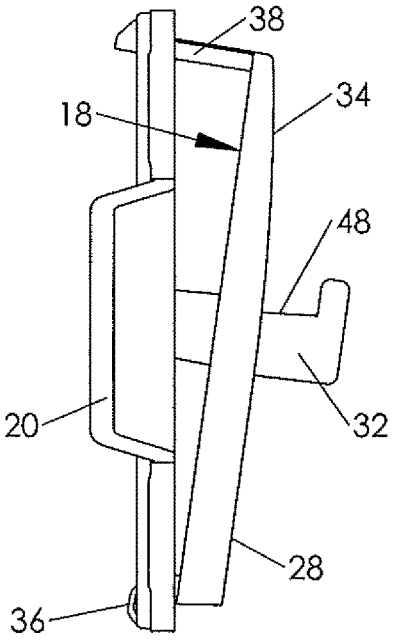
FIG. 3 is a front end view of the roll support of the first embodiment showing a hub projection thereof pivoted relative to a hub projection support and tilted downwardly from the position illustrated in FIG. 1.

The hub projection base 34 is connected by hinge 36 disposed the bottom thereof with the hub projection support 30 of roll support arm 20 and is tiltable between the positions shown in FIGS. 1 and 3. Retainer structure in the form of an elongated hook 38 on the hub projection base 34 extending through an aperture 40 of the hub projection support 30 limits pivotal movement between the hub projection an the hub projection support.

The roll support 18 is configured to include space and distinct roll core contact points. The roll core contact points are di imposed at different angles relative to vertical.

Male portion 32 has an oval-shaped outer peripheral surface with two adjacent curved upper corners 42, 44 forming the roll core contact points. The male portion has an oblong configuration and is canted, as may perhaps best be seen with respect to FIG. 2, so that the roll core holds the weight of the roll off center, the core being shown in dash lines in FIG. 2 and designated by reference numeral 46, the core 46 having a topmost upper surface 49 and core inner surface 51.

Figure 2:
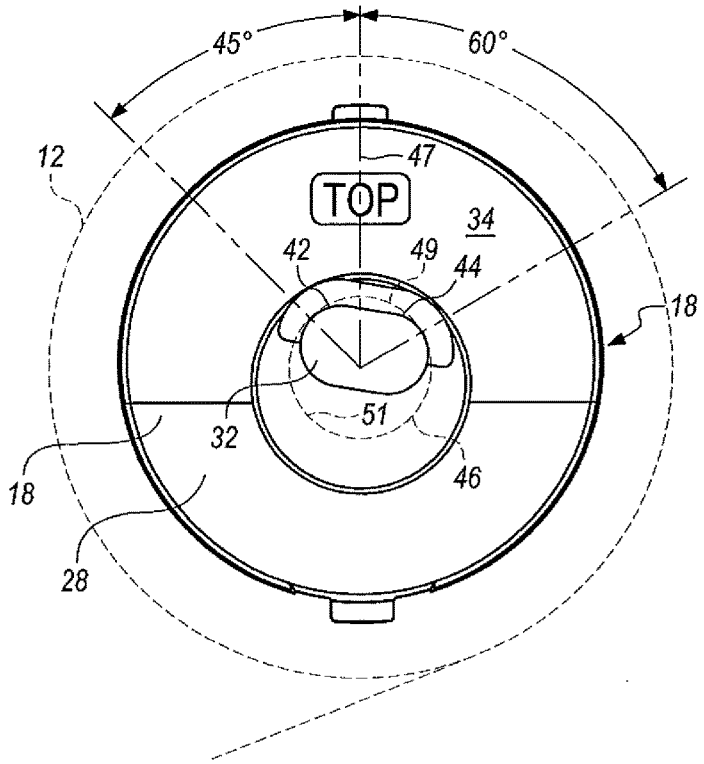
FIG. 2 is an enlarged, elevational side view depicting in solid lines the inner side of the roll support of the first embodiment and depicting in dash lines the outline of a roll of paper toweling supported thereby, positions of spaced core structure contact points of the roll support at different angles relative to vertical being indicated.

The roll core contact points are disposed at different angles to the vertical, the verticle axis identified by reference numeral 47. In FIG. 2 these angles are shown as 45 degrees and 60 degrees; however, the angles shown are relative to a specific core diameter and are tunable based on overspin reduction needed for a particular core diameter or other characteristic, such as if mated with a roll plug system and the frictional characteristics of the plug system. The hub projection male portion shape illustrated creates more frictional drag than a centered shape would, as can be depicted by a force diagram (not shown). If desired, a roll support similar to roll support 18 may also be employed at the other end of the roll as well.

An upper segment of the male portion of the roll support 18 hub projection has been cut away to leave an opening 48. This feature forces contact with the roll core away from the lateral face of the hub projection base 34.

Figure 4:
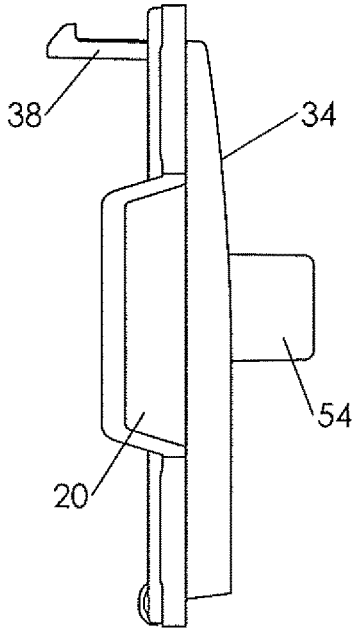
FIG. 4 is a front end view of a second embodiment illustrating the hub projection in a substantially horizontal, non-tilted position, the hub projection illustrated in FIG. 4 differing from the hub projection illustrated in FIGS. 1-3 in that the hub projection of FIG. 4 does not have a cut-away top portion as illustrated in FIGS. 1 and 3.
Figure 5:
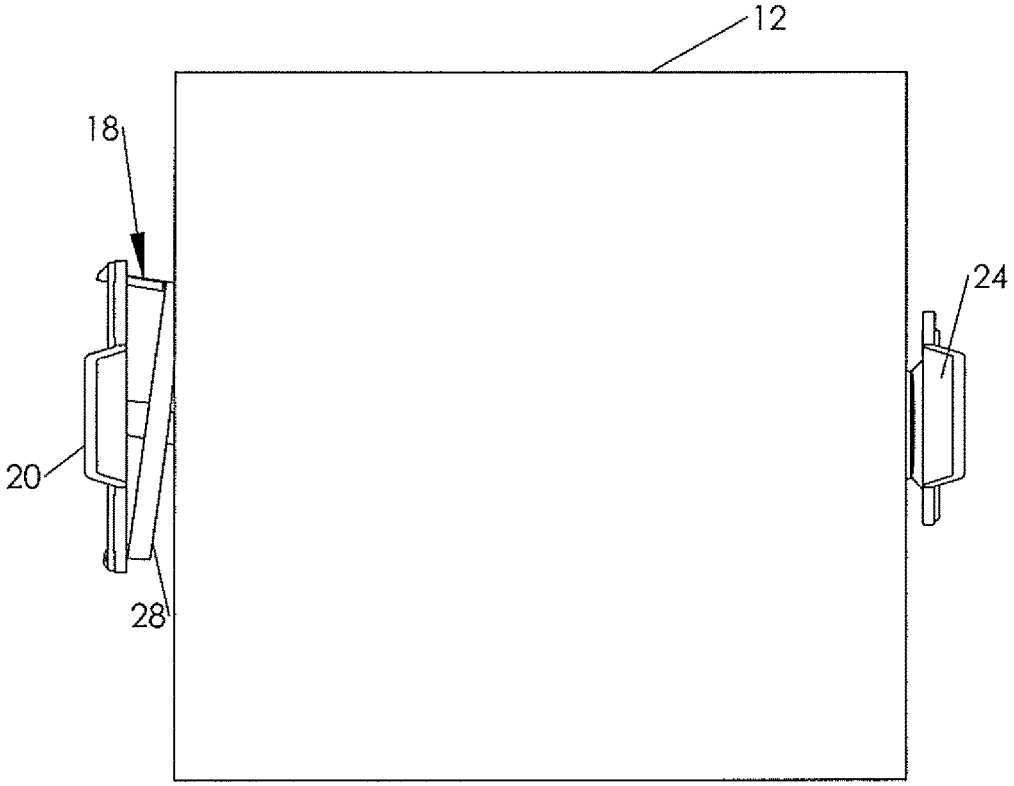
FIG. 5 is a front view depicting a roll of paper toweling supported on one side by the roll support of FIGS. 1-3 and at the other side by a conventional roll support, each roll support attached to a dispenser apparatus roll support arm.
Figure 6:
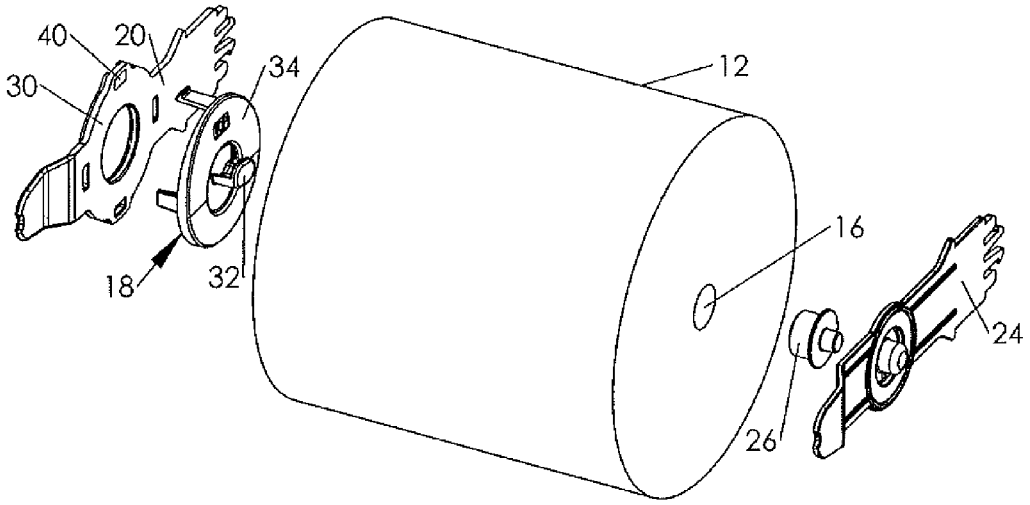
FIG. 6 is an exploded, perspective view showing the first and second roll supports shown in FIG. 5 prior to assembly with the dispenser apparatus support arms and roll.

FIG. 4 shows a second embodiment of the invention. Other than the male portion of the hub projection, components of the second embodiment are identical to the components of the first embodiment and share the same reference numbers. The male portion of this second embodiment, identified by reference numeral 54, has no cut-away upper portion and is slightly larger in size for accommodating a different sized roll core.

FIGS. 7-9, 11 and 12 disclose another alternative embodiment of the invention. In this embodiment the roll support is identified by reference numeral 60. The hub projection support is part of a roll support arm 20 and is of the same construction as the hub projection support previously described with other embodiments and bears the same reference number 30.

The hub projection 62 of this embodiment differs from that described above. More particularly, the male portion 64 and the shape of the hub projection base 66 differ. The hub projection male portion 64 is round rather than oblong in shape and has a single centered contact point 68 with the inside diameter of the roll core. This may best be seen with reference to FIG. 8.

Figure 7:
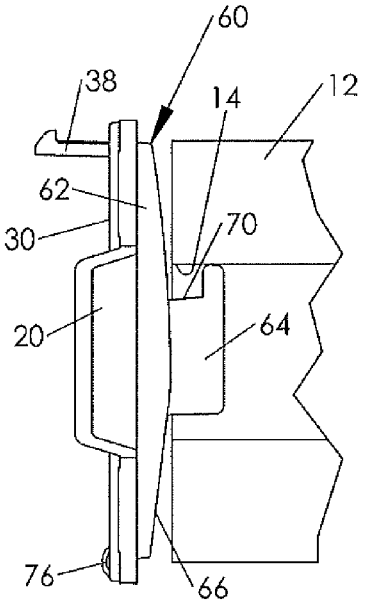
FIG. 7 is an end view of a third embodiment of the invention wherein a hub projection of alternative construction is horizontally disposed and positioned in an end opening of a roll.
Figure 8:
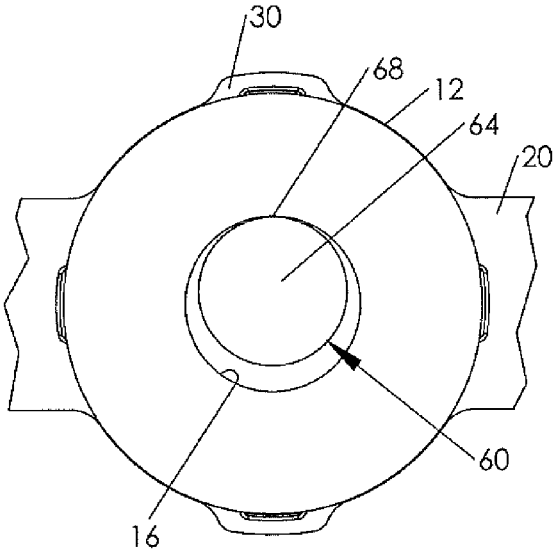
FIG. 8 is an elevation, side view of the roll showing the hub projection embodiment of FIG. 7 positioned in the roll core, horizontally disposed, and supporting an end of the roll.
Figure 9:
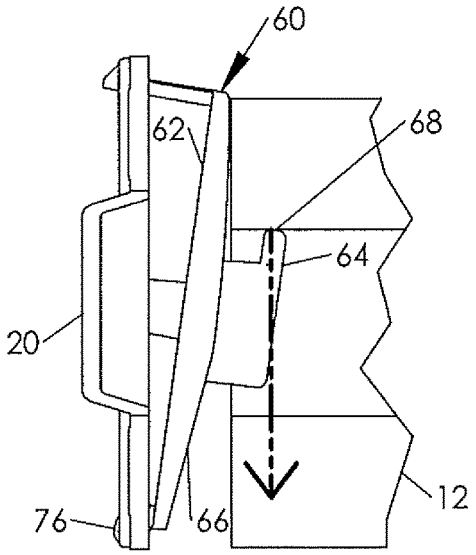
FIG. 9 is a view similar to FIG. 7 wherein the hub projection has been pivoted and is inclined downwardly relative to horizontal.

The male portion 64 forms an upper space or void 70 between the distal end of the male portion and the outer surface of hub projection base 66. FIG. 7 and FIG. 8 show the male portion 64 extending along a horizontal axis, that is, in untilted condition. The hub projection base of course is also untilted. When the hub projection 62 bears the weight of an end of the roll 12 it begins to tilt and the upper outer surface of the hub projection base 66 engages the roll end.

Figure 12:
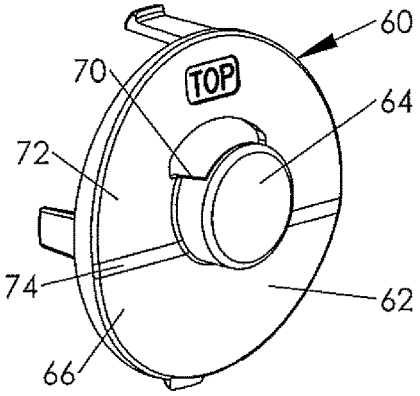
FIG. 12 is a perspective view of the roll support embodiment of FIGS. 9 and 11.

As may perhaps best be seen with reference to FIG. 12, hub projection base 66 has an upper slanted face portion 72 which extends downwardly somewhat beyond the center of the hub projection base. The upper slanted face portion may be cylindrical. Immediately below the upper slanted face portion 72 is a face portion 74 tangentially disposed relative to the face portion 72 and located a slight distance below the center of the hub projection base. In FIG. 7 face portion 74 is shown engaging the end of the roll. The weight of the roll will move the hub projection 62 to a tilted orientation, as shown for example in FIG. 9. The location where the roll end contacts the face varies with the amount of tilt or pivot.

Figure 10:
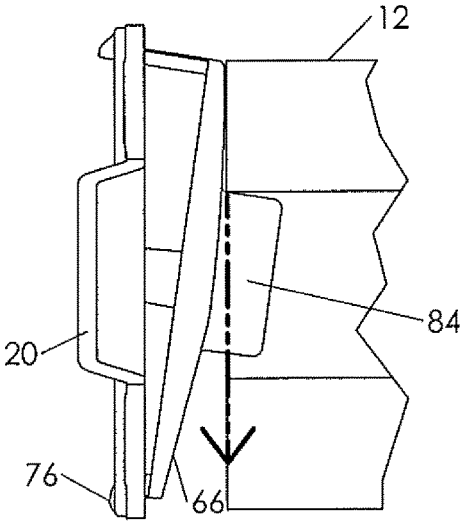
FIG. 10 is a view similar to FIG. 9, but illustrating a fourth embodiment wherein a hub projection similar to that of the embodiment of FIG. 4 tilted downwardly relative to horizontal.

Overspin reduction or control is accomplished through bias with the end of the roll created by a moment arm of roll weight applied to the male portion of the hub projection which is offset from the pivot point located at the hinge 76 pivotally connecting the hub projection base to the hub projection support 30 of the roll support arm. The cut-away top portion of the male hub projection portion creates a larger moment arm than would be accomplished without an upper space or void 70. The embodiment shown in FIG. 10 is identical to the embodiment of FIG. 9 except that the male portion 84 has no cut-away or void space. As indicated by the illustrated downwardly extending arrows in FIGS. 9 and 10, the contact point of the male portion 84 with the roll core is substantially closer to the pivot point at hinge 76, thus creating a considerably shorter moment arm.

It is typical for toweling rolls to have a width tolerance of plus/minus ⅛ inch, or more. The pivoting hub projection arrangement allows the roll support system to absorb that tolerance without excessively squeezing the maximum width rolls. The bias with the end of the roll also keeps the roll positively engaged with both roll supports so that the narrow rolls will not fall off of the supports during dispensing.

Figure 11:
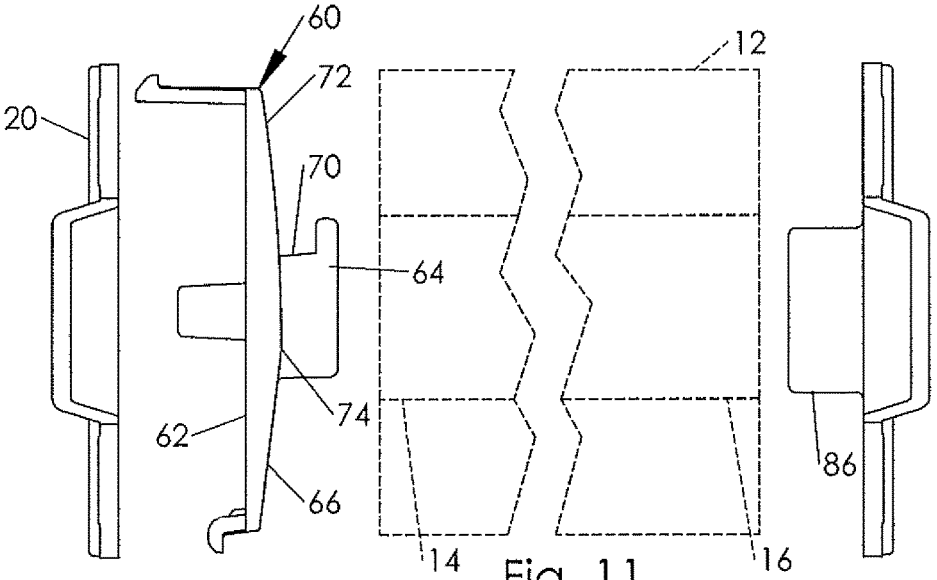
FIG. 11 is an exploded, elevational front view illustrating a roll in dash lines with solid lines depicting two roll supports prior to insertion into the end openings of the roll, one of the roll supports being the roll support shown in FIG. 7 and the other roll support being of a conventional fixed projection type attached to the other roll support arm.

FIG. 11 shows a fixed roll holder projection 86 on the right roll support.

Figure 13:
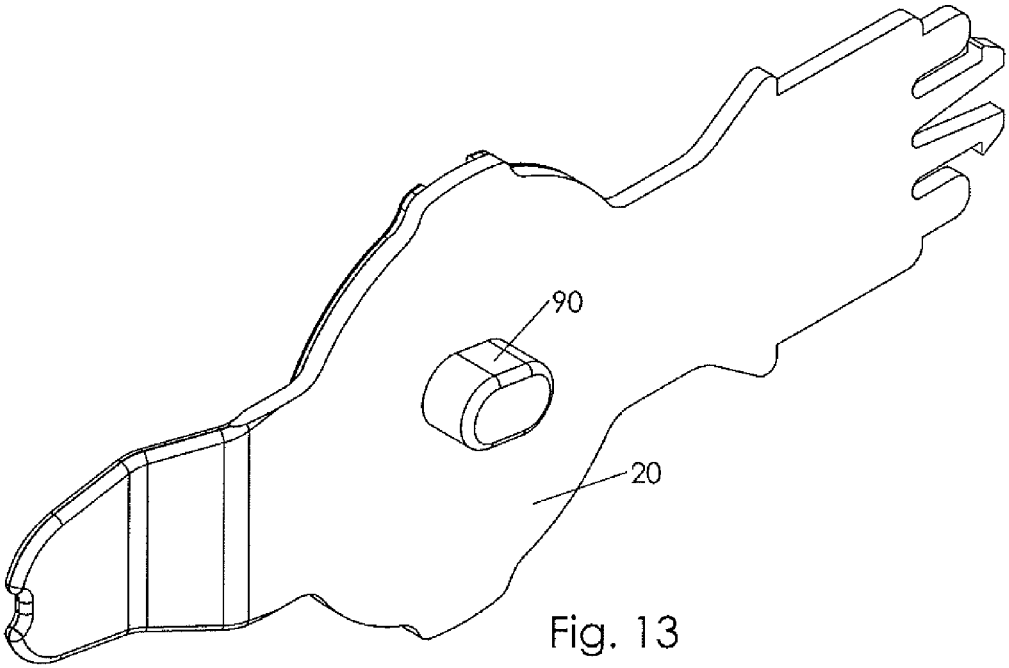
FIG. 13 discloses a fifth embodiment of the invention wherein the hub projection male portion is directly affixed to an inner surface of a dispenser apparatus roll support arm.
Figure 14:
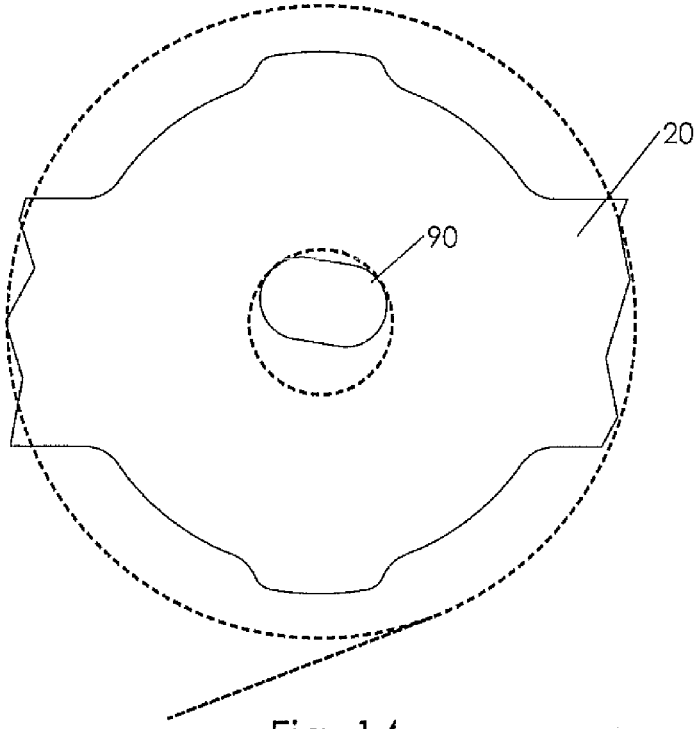
FIG. 14 is an elevation side view depicting in solid lines a portion of the hub projection arm and the male portion of the hub projection of FIG. 13 positioned relative to a core of a roll illustrated in dash lines.

FIGS. 13 and 14 show an embodiment of an invention wherein a hub projection male portion 90 is affixed to the inner surface of a roll support arm 20, for example by being integrally molded therewith. The male portion has an oval configuration and is canted to provide two roll core contact points as described above with respect to the first embodiment of the invention. Alternatively, the male portion could have a generally oval configuration with flat surfaces disposed between curved corners, for example the generally rectangular male portion shape shown in FIGS. 18 and 19.

Figure 15:
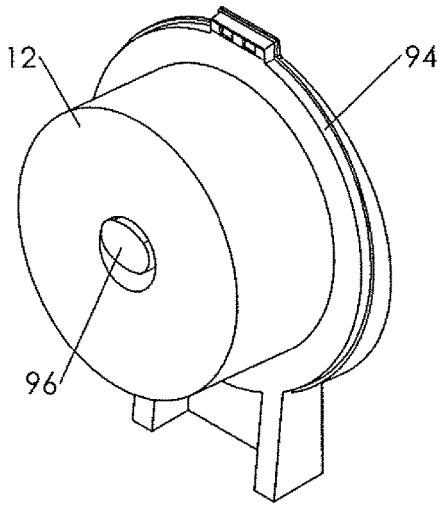
FIG. 15 is a perspective view of a sixth embodiment of the invention holding a roll wherein the hub projection is an elongated fixed mandrel with an oval-shaped peripheral surface.
Figure 16:
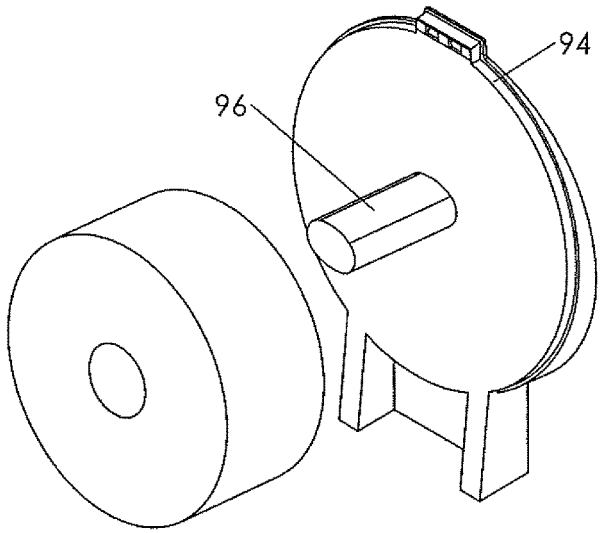
FIG. 16 is an exploded view showing the roll separated from the hub projection of FIG. 15.
Figure 17:
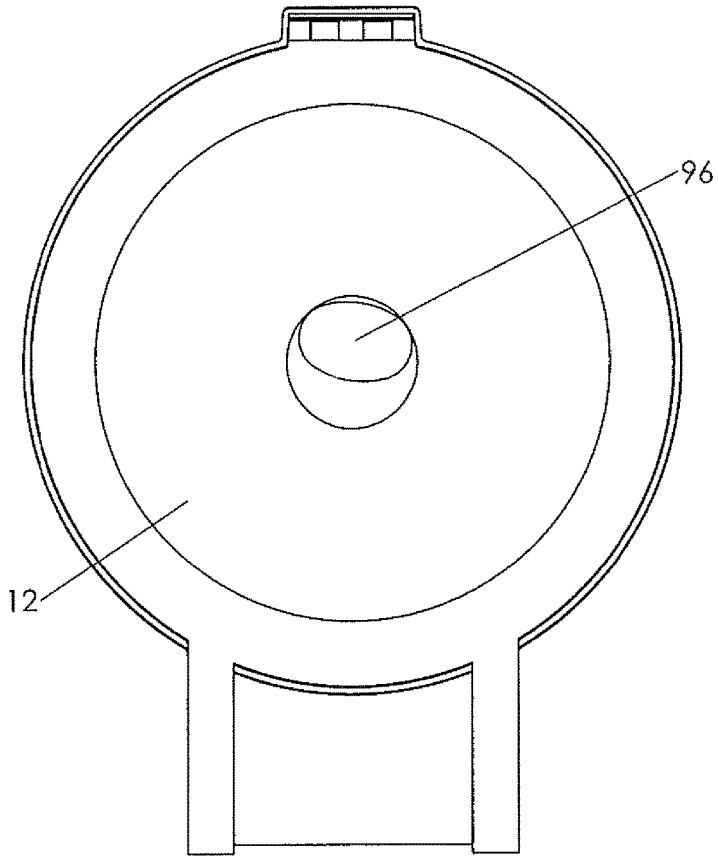
FIG. 17 is a front elevation view of the FIG. 15 embodiment showing angular orientation of the hub projection relative to the roll.

FIGS. 15-17 show a single fixed mandrel tissue dispenser 94 utilising the overspin reducing concept disclosed herein. The dispenser cover is not shown. The hub projection male portion or mandrel 96 is elongated so that it contacts all or at least a significant portion of the length of the roll tissue core. The hub projection male portion or mandrel 96 is oval shaped, having two upper curved contact corners due to canting of the mandrel.

Figure 18:
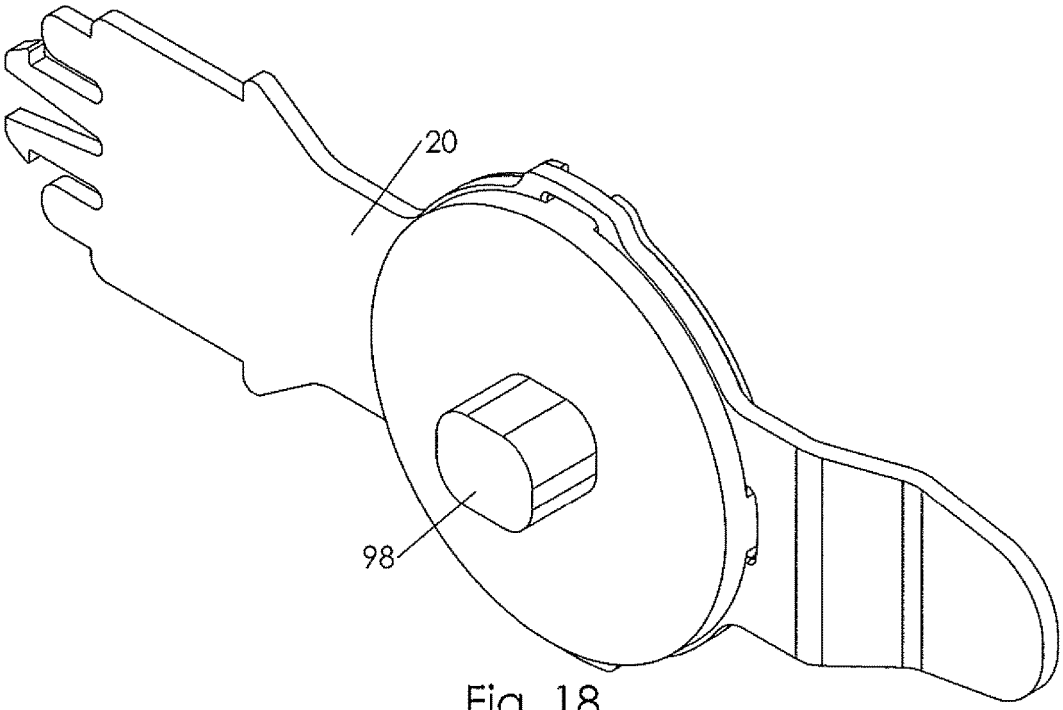
FIG. 18 is a perspective view illustrating an embodiment of the invention wherein a hub projection with generally rectangular outer peripheral surface having rounded corners projects from a roll support arm.
Figure 19:
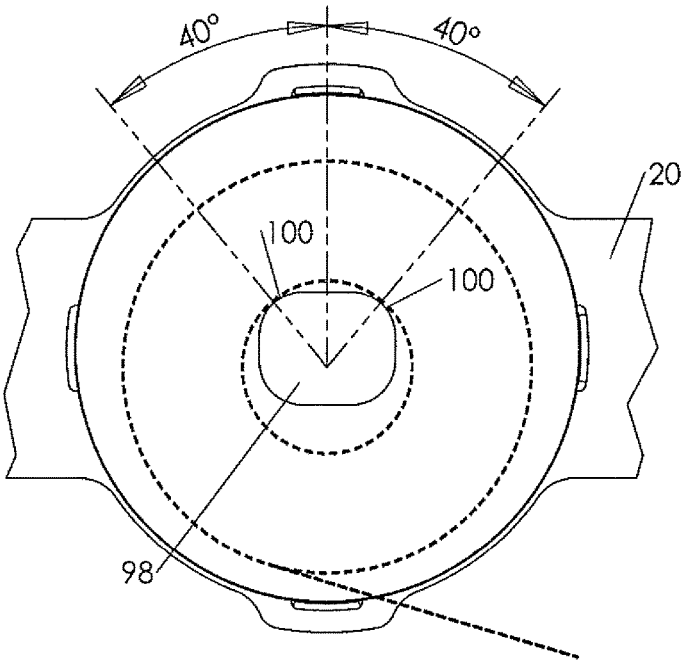
FIG. 19 is a front elevational view of the embodiment of FIG. 18.

FIGS. 18 and 19 show another embodiment of the invention wherein a hub projection male portion 98 having an outer surface of generally rectangular configuration is affixed to the inner surface of a roll support arm 20, for example being integrally molded therewith. In this embodiment the roll contact points are at upper adjacent curved corners 100 of the but projection male portion. These contact points are disposed on opposite sides of a vertical axis extending through the top-most, upper inner surface of said roll core and at the same angle (in this instance 40 degrees) relative to the vertical axis.

The overspin control features of this invention can be employed at left, right or both sides of a dual support system.

It is also to be understood that the principles of the present invention can be applied to rolls wherein the core is a traditional separate core about which paper sheet material is wound thereabout or wherein the core is formed from the same toweling as the rest of the rolls, i.e. so-called coreless-cored rolls.

The invention claimed is:

1. Dispenser apparatus for holding a roll of paper toweling or tissue sheet material having centrally disposed first and second roll support openings at opposed ends thereof and for dispensing the sheet material during rotation of said roll, said roll having a core, said dispenser apparatus including:

a first roll support positioned in the first roll support opening and a second roll support positioned in the second roll support opening, said first roll support and said second roll support operable to support said roll and allow rotation of said roll relative thereto to unwind said sheet material when a pulling force is applied to said sheet material, said first roll support including a hub projection configured to support weight of the roll off center of the core at said first roll support opening and exert frictional drag forces on said roll to reduce overspin of said roll when said pulling force is terminated, said hub projection including spaced roll core contact points at an upper surface of said hub projection for exerting a frictional drag on said roll and disposed on opposite sides of and at different angles relative to a vertical axis extending through a topmost upper surface of said core and engaging an inner surface of the core at spaced locations on the inner surface of the core.

2. The dispenser apparatus according to claim 1 wherein said first roll support additionally comprises a hub projection support, said hub projection being pivotally mounted on said hub projection support and movable between a non-inclined orientation and a downwardly inclined orientation.

3. The dispenser apparatus according to claim 2 wherein said first roll support additionally includes a retainer structure for limiting the downwardly inclined orientation of said hub projection.

4. The dispenser apparatus according to claim 2 wherein said hub projection includes a hub projection base and a canted hub projection male portion having a distal end extending from said hub projection base, said hub projection male portion defining an upper opening adjacent to said distal end and configured to force contact with the roll core at a location at said distal end and spaced from the hub projection base.

5. The dispenser apparatus according to claim 2 including a roll support arm and wherein said hub projection support is on said roll support arm.

6. The dispenser apparatus according to claim 2 wherein said hub projection includes a hub projection base having a hub projection outer surface and a hub projection male portion extending from said hub projection outer surface, the hub projection outer surface having two corner surface portions angularly disposed with respect to one another.

7. The dispenser apparatus according to claim 6 wherein said roll core contact points are at a distal end of said hub projection male portion.

8. The dispenser apparatus according to claim 1 wherein the first roll support is configured to hold the roll with the longitudinal axis of the roll angularly disposed downwardly relative to horizontal during dispensing from said roll.

9. The dispenser apparatus according to claim 6 wherein said hub projection base exerts a force against an end of the roll to keep the roll positively engaged with said first roll support.

10. The dispenser apparatus according to claim 1 wherein said hub projection has an outer peripheral surface forming upper adjacent curved corners comprising said contact points.

11. The dispenser apparatus according to claim 10 wherein said outer peripheral surface is oval-shaped.

12. The dispenser apparatus of claim 10 wherein the outer peripheral surface is rectangular shaped.

* * * * *